US011781368B2

(12) United States Patent
Nilsson et al.

(10) Patent No.: US 11,781,368 B2
(45) Date of Patent: Oct. 10, 2023

(54) SYSTEM AND METHOD FOR MANAGING OPENING AND CLOSING OF A VEHICLE WINDOW

(71) Applicant: Ningbo Geely Automobile Research & Development Co., Ltd., Ningbo (CN)

(72) Inventors: Magnus Nilsson, Floda (SE); Erik Lindberg Nilsson, Gothenburg (SE)

(73) Assignee: NINGBO GEELY AUTOMOBILE RESEARCH & DEVELOPMENT CO, Ningbo (CN)

( * ) Notice: Subject to any disclaimer, the term of this patent is extended or adjusted under 35 U.S.C. 154(b) by 115 days.

(21) Appl. No.: 17/522,495

(22) Filed: Nov. 9, 2021

(65) Prior Publication Data

US 2022/0065022 A1 Mar. 3, 2022

Related U.S. Application Data

(63) Continuation of application No. PCT/CN2020/092116, filed on May 25, 2020.

(30) Foreign Application Priority Data

May 29, 2019 (EP) ..... 19177177

(51) Int. Cl.
*E05F 15/00* (2015.01)
*E05F 15/73* (2015.01)
*E05F 15/695* (2015.01)

(52) U.S. Cl.
CPC ..... *E05F 15/73* (2015.01); *E05F 15/695* (2015.01); *E05F 2015/767* (2015.01); (Continued)

(58) Field of Classification Search
CPC . E05F 15/00; E05F 15/40; E05F 15/42; E05F 15/43; E05F 15/44; E05F 2700/00; (Continued)

(56) References Cited

U.S. PATENT DOCUMENTS 10,955,855 B1 * 3/2021 Tran ..... G05D 1/0246
11,435,740 B1 * 9/2022 Scott ..... B60W 60/0053
(Continued)

FOREIGN PATENT DOCUMENTS

CN 101198563 A 6/2008
CN 101327767 A 12/2008
(Continued)

OTHER PUBLICATIONS

International Search Report from corresponding International Application No. PCT/CN2020/092116, dated Aug. 28, 2020, 3 pages.
(Continued)

*Primary Examiner* — Chi Q Nguyen
(74) *Attorney, Agent, or Firm* — Tucker Ellis LLP

(57) ABSTRACT

A system, method and computer program product for detecting, by at least a first sensor, a position and/or movement of an object at or on at least first window, determining, if the position and/or movement of the object detected by the at least first sensor represents an intention by a vehicle occupant to move the at least first window, and responsive to a determination that the position and/or movement of the of the object represents an intention by the vehicle occupant to move the at least first window, cause the at least first window controller to initiate a movement of the at least first window accordingly.

12 Claims, 7 Drawing Sheets

(52) U.S. Cl.
CPC ..... *E05Y 2400/82* (2013.01); *E05Y 2400/822* (2013.01); *E05Y 2400/86* (2013.01); *E05Y 2900/55* (2013.01)

(58) Field of Classification Search
CPC . E05F 15/695; E05F 15/689; E05F 2015/767; E05F 15/78; E05F 15/73; E05Y 2400/82; E05Y 2400/822; E05Y 2400/818; E05Y 2400/86; E05Y 2900/55
See application file for complete search history.

(56) References Cited

U.S. PATENT DOCUMENTS

| | | | | |
|---|---|---|---|---|
| 11,584,014 | B2 * | 2/2023 | Kassar | B25J 5/00 |
| 11,590,884 | B2 * | 2/2023 | Oh | B60Q 1/50 |
| 11,628,764 | B2 * | 4/2023 | Im | B60Q 1/50 340/463 |
| 2006/0145825 | A1 * | 7/2006 | Mc Call | B60R 25/2045 340/426.35 |
| 2008/0302014 | A1 | 12/2008 | Szczerba | |
| 2016/0357187 | A1 * | 12/2016 | Ansari | G06T 19/003 |
| 2017/0349090 | A1 | 12/2017 | Dellock et al. | |
| 2018/0266164 | A1 | 9/2018 | Yogo | |
| 2018/0354367 | A1 * | 12/2018 | Mertens | B60K 35/00 |
| 2019/0146500 | A1 * | 5/2019 | Yalla | G01C 21/3602 701/25 |
| 2020/0131839 | A1 * | 4/2020 | Iwano | G06F 3/017 |
| 2020/0325721 | A1 * | 10/2020 | Yogo | E06B 9/24 |
| 2023/0127664 | A1 * | 4/2023 | Brown | G01J 1/4228 356/218 |

FOREIGN PATENT DOCUMENTS

| | | | |
|---|---|---|---|
| CN | 106382072 | A | 2/2017 |
| CN | 106401357 | A | 2/2017 |
| CN | 106499294 | A | 3/2017 |
| CN | 107521433 | A | 12/2017 |
| CN | 108086857 | A | 5/2018 |
| CN | 108625717 | A | 10/2018 |
| DE | 102011002801 | A1 | 7/2012 |
| JP | 2004075501 | A | 3/2004 |
| JP | 2015034459 | A | 2/2015 |
| JP | 2019027157 | A | 2/2019 |
| KR | 101339251 | B1 | 12/2013 |

OTHER PUBLICATIONS

Extended European Search Report from corresponding European Application No. 19177177.3 dated Dec. 12, 2019, 8 pages.
Search Report from corresponding Chinese Application No. International Application No. 202080038708X, dated Jan. 14, 2023, 2 pages.

* cited by examiner

SYSTEM AND METHOD FOR MANAGING OPENING AND CLOSING OF A VEHICLE WINDOW

RELATED APPLICATION DATA

This application is a continuation of International Patent Application No. PCT/CN2020/092116, filed May 25, 2020, which claims the benefit of European Patent Application No. 19177177.3, filed May 29, 2019, the disclosures of which are incorporated herein by reference in their entireties.

TECHNICAL FIELD

The disclosure pertains to the field of opening and closing of a vehicle window.

BACKGROUND

Most vehicles today are equipped with windows that can be opened and closed. Opening and closing of the windows is desired for many different reasons. A common reason is to make the vehicle compartment climate comfortable for the vehicle occupants, e.g. a pleasant summer day it may be desired to open the windows and let some of the air into the vehicle compartment. But it is also desired to open the window for other reasons, to e.g. get a ticket when entering a parking garage etc. Some vehicle windows can be opened manually by manpower, by using a crank, to move the window up or down. Most modern vehicles today are however equipped with windows that can be opened and closed with help from e.g. an electric motor. The vehicle occupant then uses a switch to operate the opening and closing of the window. The switch is often mounted on the door that comprises the window to be opened or closed. The switch can also be mounted on the control panel or e.g. between the driver and the passenger seats. The switch often comprises one or more buttons that are operated by e.g. pressing or dragging the buttons.

SUMMARY

There is a demand for an easier and more convenient way to control the opening and closing of a vehicle window. In particular there is a need for an intuitive way to control the opening and closing of a vehicle window that does not require a dedicated control switch with buttons mounted on the door or elsewhere in the vehicle compartment. An object of the present disclosure is to provide vehicle window control system and method for managing the opening and closing of a window which seek to mitigate, alleviate, or eliminate one or more of the above-identified deficiencies in the art and disadvantages singly or in any combination.

The disclosure proposes a vehicle window control system for managing movement of at least a first window. The vehicle window control system comprises at least a first window controller configured to move the at least first window and at least a first sensor configured to detect a position and/or movement of an object. The vehicle window control system further comprises a processing circuitry operatively connected to the at least first sensor and the at least first window controller. The processing circuitry is configured to cause the window control system to detect a position and/or movement of an object at or on the at least first window and determine, if the position and/or movement of the object detected by the at least first sensor represents an intention by a vehicle occupant to move the at least first window, and responsive to a determination that the position and/or movement of the of the object represents an intention by the vehicle occupant to move the at least first window, cause the at least first window controller to initiate a movement of the at least first window accordingly. An advantage with the vehicle window control system is that the vehicle occupant can operate the at least first window intuitively by e.g. a finger at or on the window, without the need for a certain switch or button for operating the at least first window.

According to an aspect the intention by the vehicle occupant to move the window is determined by that the position of the object is at a first position within at least a first active area at or on the at least first window and the movement of the at least first window is a first movement of the at least a first window. This means that when the object is at the first position within the at least a first active area, the operation of the at least first window can be one of a plurality of predefined operations causing the at least first window to move accordingly.

According to an aspect the processing circuitry is configured to cause the window control system to further determine a second position of the object within the at least first active wherein the second position of the object is determined within a certain time from the determination of the first position of the object, and cause the at least a first window controller to initiate a movement of the at least first window that is a second movement of the at least first window. This means that when the object is moved from one position to another, e.g. swiped, from the first position to the second position, the operation of the at least first window can be one of a plurality of predefined operations causing the at least first window to move accordingly.

According to an aspect the at least first sensor is configured to emit light and detect a reflection of the emitted light caused by the object. In other words if the object comes in the way of the emitted light, the position of the object can be determined by the reflected light.

According to an aspect the at least first sensor is configured to detect light from at least a first light source. An advantage with this aspect is that it can be detected if the object comes in between the at least first light source and the at least first sensor for determining the position of the object.

According to an aspect the at least first light source is configured to emit light with a certain wavelength and/or emit a pulsing light that is pulsing at a certain frequency. An advantage with light with a certain wavelength and/or a pulsing light that is pulsing at a certain frequency is that the at least first sensor can be configured to only detect light with the certain wavelength and/or the certain pulse frequency of the pulsing light for determining the position of the object.

According to an aspect, the at least first sensor is configured to determine at least one of a distance and a direction to the object relative to the position of the at least first sensor. In other words this means that the position of the object can be determined.

According to an aspect the at least first sensor is configured to determine a position of the object, relative to the position of the at least first window. An advantage with this aspect is that since the at least first window is movable, the position of the object relative to the at least first window can be changed dynamically when the at least first window is moving, compared to the position of the object relative to the at least first sensor that is static.

According to an aspect the at least first window comprising at least a first symbol. According to an aspect the at least first window comprising at least a first symbol. According to an aspect the at least first window comprising at least a first symbol, wherein the at least first symbol is displayed only when the at least first symbol is lit by light. This means that the at least first symbol can be seen only when lit by light and e.g. be transparent if not lit by light in order to provide a see-through window.

According to an aspect the at least first window comprising at least a first layer and the at least first symbol is comprised in the at least first layer. According to an aspect the at least first window comprising at least a first layer and a second layer and the first symbol is comprised in the first layer and a second symbol is comprised in the second layer. This solution provides for e.g. the advantage that different symbols can be comprised in different layers of the at least first window.

The disclosure further proposes a method for managing movement of at least a first window. The method comprising the step of detecting, by at least a first sensor, a position and/or movement of an object at or on the at least first window. The method further comprising the step of determining, if the position and/or movement of the object detected by the at least first sensor represents an intention by a vehicle occupant to move the at least first window and responsive to a determination that the position and/or movement of the of the object represents an intention by the vehicle occupant to move the at least first window, cause the at least first window controller to initiate a movement of the at least first window accordingly. An advantage with the vehicle window control system is that the vehicle occupant can operate the at least first window intuitively by e.g. a finger at or on the window, without the need for a certain switch or button for operating the at least first window.

According to an aspect the intention by the vehicle occupant to move the at least first window is determined by that the position of the object is at a first position within at least a first active area at or on the at least first window and that the movement of the at least first window is a first movement of the at least first window. This means that when the object is at the first position within the at least a first active area, the operation of the at least first window can be one of a plurality of predefined operations causing the at least first window to move accordingly.

According to an aspect the method further comprising a determination of a second position of the object within the at least first active area, and the second position of the object is determined within a certain time from the determination of the first position of the object, causing the at least a first window controller to initiate a movement of the at least first window that is a second movement of the at least a first window. This means that when the object is moved from one position to another, e.g. swiped, from the first position to the second position, the operation of the at least first window can be one of a plurality of predefined operations causing the at least first window to move accordingly.

The disclosure further proposes a computer program product comprising a non-transitory computer readable medium, having thereon a computer program comprising program instructions, the computer program being loadable into a processing circuitry and configured to cause execution of the method when the computer program is run by the at least one processing circuitry.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments.

DETAILED DESCRIPTION

Figure 1A:
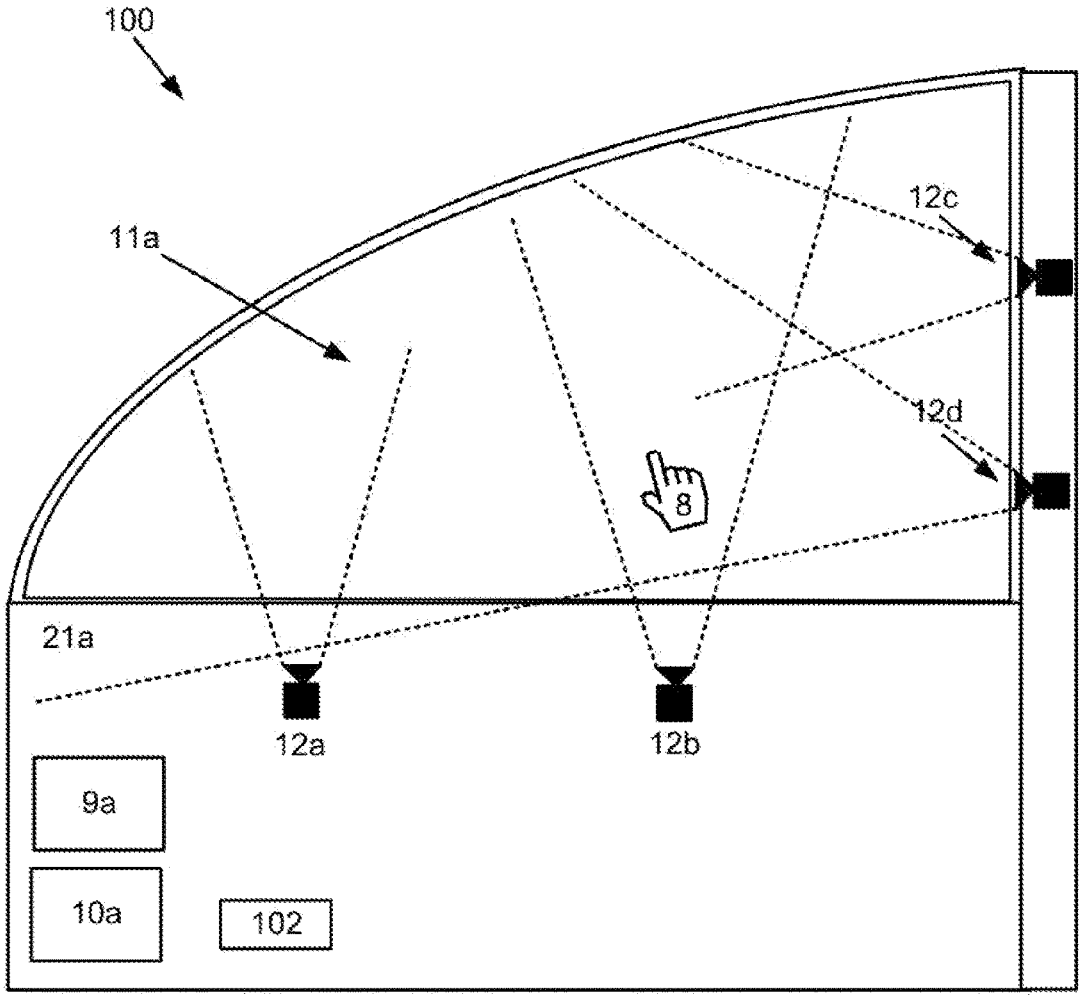
FIG. 1A illustrates a vehicle window control system according to an aspect of the disclosure.

Aspects of the present disclosure will be described more fully hereinafter with reference to the accompanying drawings. The method and device disclosed herein can, however, be realized in many different forms and should not be construed as being limited to the aspects set forth herein. Like numbers in the drawings refer to like elements throughout.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

In some implementations and according to some aspects of the disclosure, the functions or steps noted in the blocks can occur out of the order noted in the operational illustrations. For example, two blocks shown in succession can in fact be executed substantially concurrently or the blocks can sometimes be executed in the reverse order, depending upon the functionality/acts involved.

In the drawings and specification, there have been disclosed exemplary aspects of the disclosure. However, many variations and modifications can be made to these aspects without substantially departing from the principles of the present disclosure. Thus, the disclosure should be regarded as illustrative rather than restrictive, and not as being limited to the particular aspects discussed above. Accordingly, although specific terms are employed, they are used in a generic and descriptive sense only and not for purposes of limitation.

It should be noted that the word "comprising" does not necessarily exclude the presence of other elements or steps than those listed and the words "a" or "an" preceding an element do not exclude the presence of a plurality of such elements. It should further be noted that any reference signs do not limit the scope of the claims, that the example embodiments may be implemented at least in part by means of both hardware and software, and that several "means", "units" or "devices" may be represented by the same item of hardware.

Today most modern vehicles are equipped with windows that can be opened and closed with help from e.g. an electric motor. The vehicle occupant commonly uses a switch to operate the opening and closing of the window. The switch is often mounted on the door that comprises the window to be opened or closed. The switch can also be mounted on the control panel or e.g. between the driver and the passenger seats. The switch often comprises one or more buttons that are operated by e.g. pressing or dragging the buttons.

There is a demand for an easier and more convenient way to control the opening and closing of a vehicle window. In particular there is a need for an intuitive way to control the opening and closing of a vehicle window that does not require a dedicated control switch with buttons mounted on the door or elsewhere in the vehicle compartment. An object of the present disclosure is to provide vehicle window control system and method for managing the opening and closing of a window which seek to mitigate, alleviate, or eliminate one or more of the above-identified deficiencies in the art and disadvantages singly or in any combination.

Figure 1B:
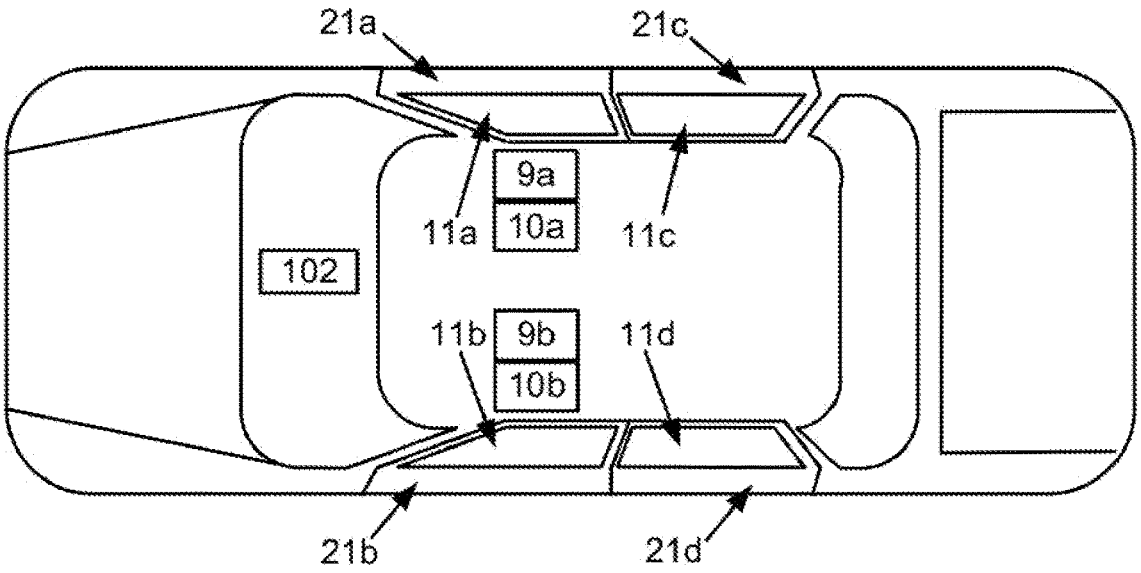
FIG. 1B illustrates an overview of a vehicle with doors and windows according to an aspect of the disclosure.

The disclosure proposes a vehicle window control system 100 for managing movement of at least a first window 11*a*, 11*b*, 11*c*, 11*d*. As illustrated in FIGS. 1A and 1B, the vehicle window control system 100 comprises at least a first window controller 10*a*, 10*b* configured to move the at least first window 11*a*, 11*b*, 11*c*, 11*d*. According to an aspect the at least first window controller 10*a*, 10*b* is configured to activate motors 9*a*, 9*b* that move the at least first window 11*a*, 11*b*, 11*c*, 11*d*. FIG. 1B illustrates an overview of a vehicle with doors and windows according to an aspect of the disclosure. The example vehicle in FIG. 1B has four doors 21*a*, 21*b*, 21*c*, 21*d* all with windows 11*a*, 11*b*, 11*c*, 11*d*. According to an aspect the at least first window controller 10*a*, 10*b* is comprised in the door 21*a*, 21*b*, 21*c*, 21*d*. As illustrated in FIG. 1A the vehicle window control system 100 further comprises at least a first sensor 12*a*, 12*b*, 12*c*, 12*d* configured to detect a position and/or movement of an object 8. The FIG. 1A illustrates a vehicle window control system according to an aspect of the disclosure. In the illustration in FIG. 1A four sensors 12*a*, 12*b*, 12*c*, 12*d* are illustrated. If more sensors are used a more precise detection of the position and/or the movement of the object 8 can be determined. According to an aspect the sensor 12*a*, 12*b*, 12*c*, 12*d* may have the size of the full length of the at least first window 11*a*, 11*b*. According to an aspect the sensor 12*a*, 12*b*, 12*c*, 12*d* may have the size of the full height of the at least first window 11*a*, 11*b*. According to an aspect a plurality of sensors 12*a*, 12*b*, 12*c*, 12*d* are mounted around the window of the door 21*a*, 21*b*, 21*c*, 21*d*.

According to an aspect the object 8 is any object. According to an aspect the object 8 is a part of the vehicle occupant, e.g. a finger or a hand of the vehicle occupant. According to an aspect the position and/or movement of a finger or a hand is detected on or at the inside of the at least first window 11*a*, 11*b* from a vehicle occupant inside of the vehicle.

The vehicle window control system 100 further comprises a processing circuitry 102 operatively connected to the at least first sensor 12*a*, 12*b*, 12*c*, 12*d* and the at least first window controller 10*a*, 10*b*. As illustrated in FIG. 1A the processing circuitry 102 is comprised in the door 21*a*. As illustrated in FIG. 1B the processing circuitry 102 is the processing circuitry of the vehicle on-board computer. The processing circuitry 102 is configured to cause the window control system 100 to detect a position and/or movement of an object 8 at or on the at least first window 11*a*, 11*b*, 11*c*, 11*d* and determine, if the position and/or movement of the object 8 detected by the at least first sensor 12*a*, 12*b*, 12*c*, 12*d*, represents an intention by a vehicle occupant to move the at least first window 11*a*, 11*b*, 11*c*, 11*d*.

According to an aspect the intention by the vehicle occupant to move the at least first window 11*a*, 11*b*, 11*c*, 11*d* is determined by that the position of the object 8 is within a predefined position at the at least first window 11*a*, 11*b*, 11*c*, 11*d*. According to an aspect the determination that the object 8 is within a predefined position at the at least first window 11*a*, 11*b*, 11*c*, 11*d* causes the at least first window controller 10*a*, 10*b* to initiate a predetermined movement of the at least first window 11*a*, 11*b*, 11*c*, 11*d*.

According to an aspect the intention by the vehicle occupant to move the at least first window 11*a*, 11*b*, 11*c*, 11*d* is determined by that the movement of the object 8 corresponds to a predetermined movement at the at least first window 11*a*, 11*b*, 11*c*, 11*d*. According to an aspect a movement of the object 8 is an upwards movement which causes the at least first window controller 10*a*, 10*b* to initiate an upwards movement of the at least first window 11*a*, 11*b*, 11*c*, 11*d*. According to an aspect a movement of the object 8 is a downwards movement which causes the at least first window controller 10*a*, 10*b* to initiate an downward movement of the at least first window 11*a*, 11*b*, 11*c*, 11*d*.

According to an aspect the position and/or movement of the object 8 is detected on the at least first window 11*a*, 11*b*, 11*c*, 11*d*.

According to an aspect the at least first window controller 10*a*, 10*b* is configured to initiate a movement of the at least first window 11*a*, 11*b*, 11*c*, 11*d* as long as the position and/or movement of the object 8 detected by the at least first sensor 12*a*, 12*b*, 12*c*, 12*d*. In an example, as long as a finger is detected on the at least first window 11*a*, 11*b*, 11*c*, 11*d*, the at least first window 11*a*, 11*b*, 11*c*, 11*d* is moving. In an example, when the at least a first sensor 12*a*, 12*b*, 12*c*, 12*d* does not detect a finger on the at least first window 11*a*, 11*b*, 11*c*, 11*d* the at least first window controller 10*a*, 10*b* cease movement of the at least first window 11*a*, 11*b*, 11*c*, 11*d*.

According to an aspect the position and/or movement of the object 8 is detected at the at least first window 11*a*, 11*b*, 11*c*, 11*d*.

In an example the position and/or movement of the object 8 is detected at the door 21*a*, 21*b*, 21*c*, 21*d* around the at least first window 11*a*, 11*b*, 11*c*, 11*d*.

According to an aspect the position and/or movement of the object 8 is detected at a predefined location at a door 21*a*, 21*b*, 21*c*, 21*d* arranged at the at least first window 11*a*, 11*b*, 11*c*, 11*d*.

The processing circuitry 102 is configured to cause the window control system 100 to detect a position and/or movement of an object 8 at or on the at least first window 11*a*, 11*b*, 11*c*, 11*d* and determine, if the position and/or movement of the object 8 detected by the at least first sensor 12*a*, 12*b*, 12*c*, 12*d* represents an intention by a vehicle occupant to move the at least first window 11*a*, 11*b*, 11*c*, 11*d*, and in responsive to a determination that the position and/or movement of the of the object 8 represents an intention by the vehicle occupant to move the at least first window 11*a*, 11*b*, 11*c*, 11*d*, cause the at least first window controller 10*a*, 10*b* to initiate a movement of the at least first window 11*a*, 11*b*, 11*c*, 11*d* accordingly. An advantage with the vehicle window control system 100 is that the vehicle occupant can operate the at least first window 11*a*, 11*b*, 11*c*, 11*d* intuitively by e.g. a finger at or on the window, without the need for a certain switch or button for operating the at least first window 11*a*, 11*b*, 11*c*, 11*d*.

FIG. 1A illustrates a vehicle window control system according to an aspect of the disclosure. In the illustration in FIG. 1A, the object 8 is in form of a finger of the vehicle occupant. The sensors 12*b* and 12*d* detect the finger. In an example the finger is touching the window 11*a*. In an example the finger is not touching the window 11*a*. According to an aspect an upwards movement of the object 8, e.g. the finger, causes the window 11*a* to move upwards. According to an aspect a downwards movement of the object 8, e.g. the finger, causes the window 11*a* to move downwards. According to an aspect the detection of the object 8 at a certain position causes the window to go from a moving state to a non-moving state, e.g. to a stop. In a use case example with reference to FIG. 1A, a downwards movement of the finger 8 is detected by the sensors 12*b*, 12*c* and 12*d* which causes the window 11*a* to move downwards. While the window 11*a* is moving downwards another position of the finger 8 is detected by the sensors 12*b* and 12*d* that causes the window 11*b* to go from the moving state to a stop.

Figure 3:
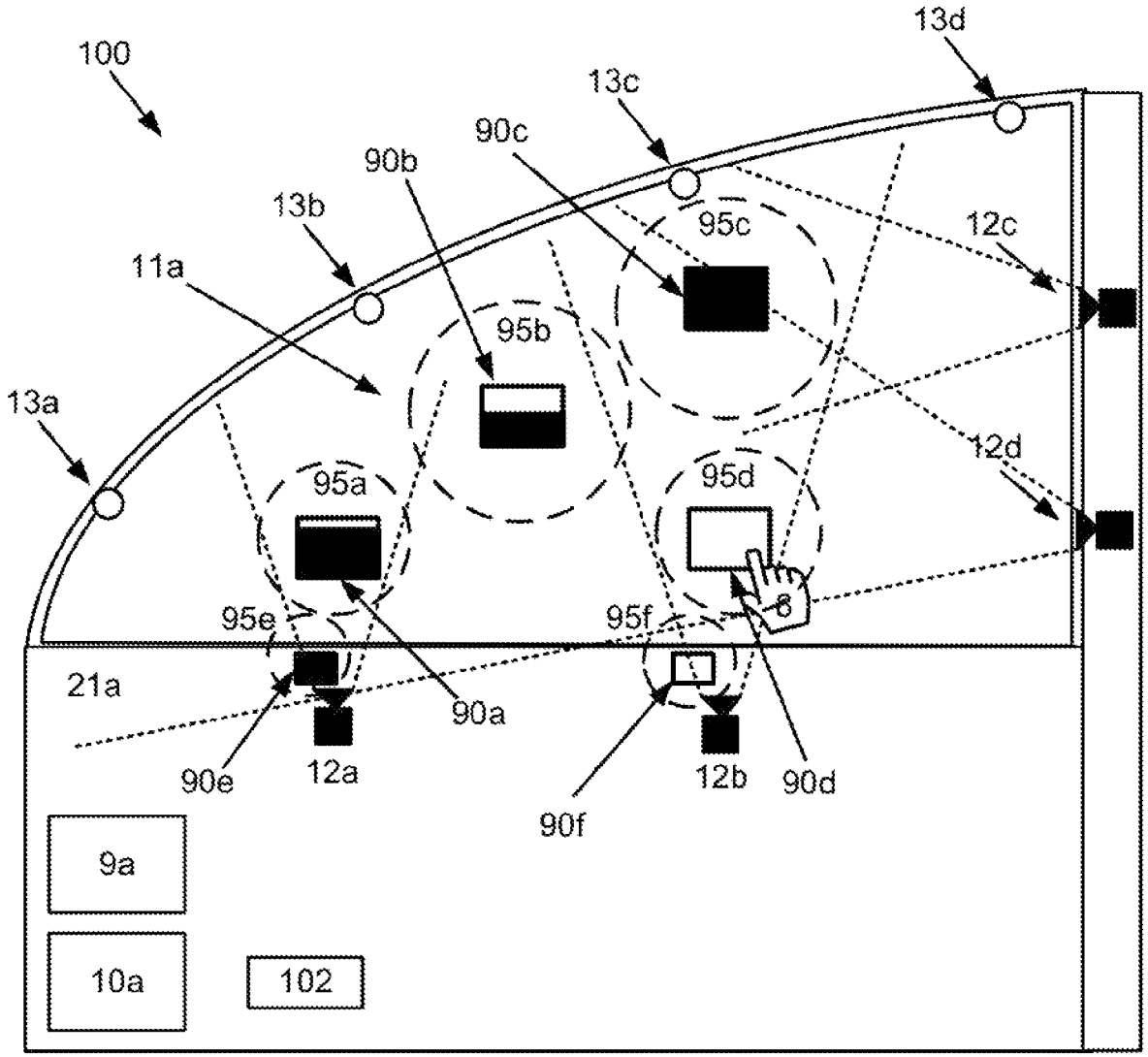
FIG. 3 illustrates example symbols and active areas at or on a window according to an aspect of the disclosure.
Figure 4A:
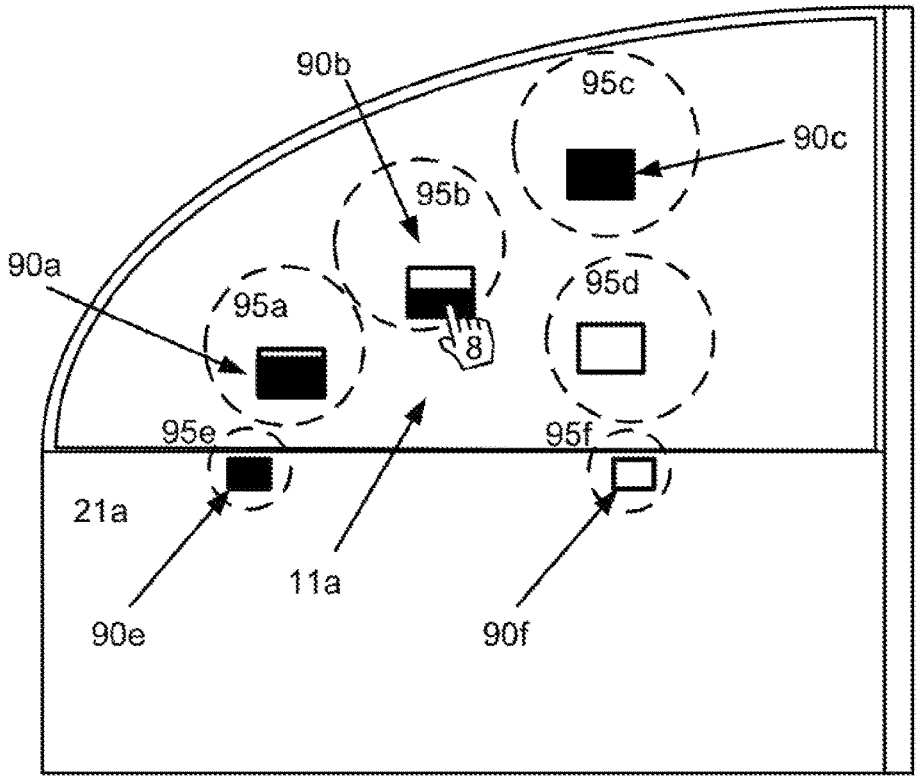
FIG. 4A illustrates example symbols and active areas at or on a window in a closed position according to an aspect of the disclosure.

According to an aspect, the intention by the vehicle occupant to move the window is determined by that the position of the object 8 is at a first position P1 within at least a first active area 95*a*, 95*b*, 95*c*, 95*d*, 95*e*, 95*f* at or on the at least first window 11*a*, 11*b*, 11*c*, 11*d* and the movement of the at least first window 11*a*, 11*b*, 11*c*, 11*d* is a first movement of the at least a first window 11*a*, 11*b*, 11*c*, 11*d*. Example active areas 95*a*, 95*b*, 95*c*, 95*d*, 95*e*, 95*f* are visualised in FIG. 3. This means that when the object 8 is at the first position P1 within the at least a first active area 95*a*, 95*b*, 95*c*, 95*d*, 95*e*, 95*f*, the operation of the at least first window 11*a*, 11*b*, 11*c*, 11*d* can be one of a plurality of predefined operations causing the at least first window 11*a*, 11*b*, 11*c*, 11*d* to move accordingly. In an example, as illustrated in FIG. 4A followed by FIG. 4B, the first movement of the window 11*a* is to half open the window 11*a*.

Figure 2A:
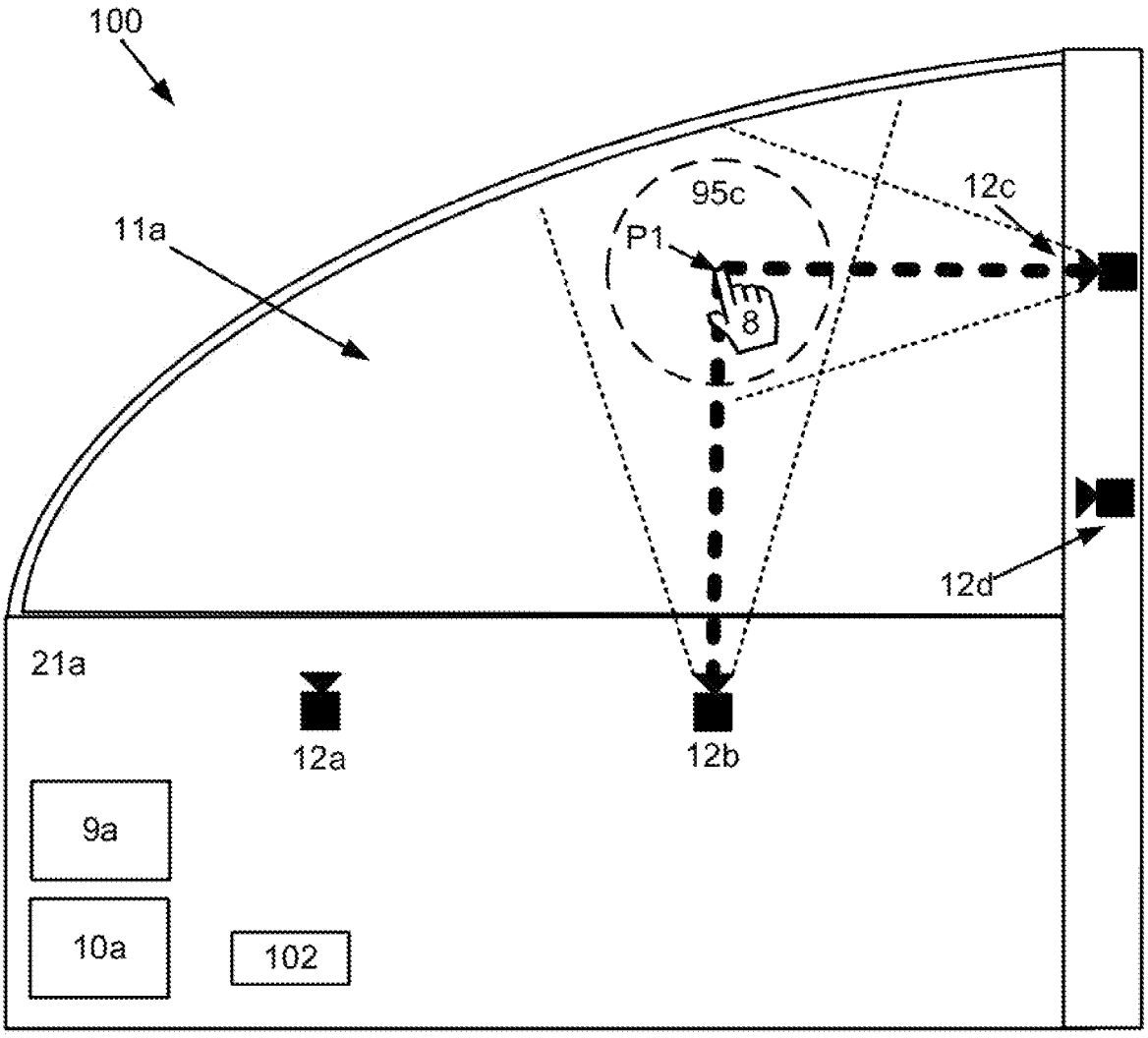
FIG. 2A illustrates the object at a first position within an active area at or on a window according to an aspect of the disclosure.

FIG. 2A illustrates the object 8 at a first position P1 within the active area 95*c* at or on the window 11*a* according to an aspect of the disclosure. In the illustration in FIG. 2A, the object 8 is in form of a finger of the vehicle occupant. In the example, the sensors 12*b* and 12*c* detects the finger 8 at the first position P1 within the active area 95*c*. In an example the finger 8 is touching the window 11*a* within the active area 95*c*. In an example the finger is not touching the window 11*a*, however the finger is within the active area 95*c*.

According to an aspect the at least first active area 95*a*, 95*b*, 95*c*, 95*d*, 95*e*, 95*f* is defined by an area where at least a first sensor 12*a*, 12*b*, 12*c*, 12*d* is configured to detect a position and/or movement of an object 8. According to an aspect the at least first active area 95*a*, 95*b*, 95*c*, 95*d*, 95*e*, 95*f* is a sub area of at least a second active area 95*a*, 95*b*, 95*c*, 95*d*, 95*e*, 95*f* According to an aspect the at least first active area 95*a*, 95*b*, 95*c*, 95*d*, 95*e*, 95*f* overlaps with at least a second active area 95*a*, 95*b*, 95*c*, 95*d*, 95*e*, 95*f*.

According to an aspect the at least first active area 95*a*, 95*b*, 95*c*, 95*d*, 95*e*, 95*f* is defined by an area where at least a first sensor 12*a*, 12*b*, 12*c*, 12*d* is configured to detect a position and/or movement of an object 8 independent of if the at least first window 11*a*, 11*b*, 11*c*, 11*d* is present in the at least first active area 95*a*, 95*b*, 95*c*, 95*d*, 95*e*, 95*f* or not. According to an aspect the at least first active area 95*a*, 95*b*, 95*c*, 95*d*, 95*e*, 95*f* is the area in the air if the at least first window 11*a*, 11*b*, 11*c*, 11*d* is not present.

According to an aspect the at least first active area 95*a*, 95*b*, 95*c*, 95*d*, 95*e*, 95*f* is defined in a two dimensional plane. In an example the at least first active area 95*a*, 95*b*, 95*c*, 95*d*, 95*e*, 95*f* is a surface at or on the at least first window 11*a*, 11*b*, 11*c*, 11*d*. In an example the surface is the window surface. In an example the surface is the surface of the door. According to an aspect the at least first active area 95*a*, 95*b*, 95*c*, 95*d*, 95*e*, 95*f* is defined in a three dimensional plane. In an example the at least first active area 95*a*, 95*b*, 95*c*, 95*d*, 95*e*, 95*f* is a spherical space at or on the at least first window 11*a*, 11*b*, 11*c*, 11*d*.

According to an aspect the at least first active area 95*a*, 95*b*, 95*c*, 95*d*, 95*e*, 95*f* corresponds to a predefined operation of the at least first window 11*a*, 11*b*, 11*c*, 11*d*. According to an aspect the at least first active area 95*a*, 95*b*, 95*c*, 95*d*, 95*e*, 95*f* corresponds to a predefined operation of the at least first window 11*a*, 11*b*, 11*c*, 11*d* dependent on the position of the at least first window 11*a*, 11*b*, 11*c*, 11*d*. According to an aspect the position of the at least first window 11*a*, 11*b*, 11*c*, 11*d* can be any position between a closed state and a fully open state.

In an example, a determination that a finger is at the same position, i.e. not moving, cause a first movement of the at least first window 11*a*, 11*b*, 11*c*, 11*d* that represents a predefined movement dependent on where the finger is positioned e.g. to open the window by half.

According to an aspect the at least first window controller 10*a*, 10*b* is configured to initiate a movement of the at least first window 11*a*, 11*b*, 11*c*, 11*d* after determination that the position of the object 8 is at a first position P1 within at least a first active area 95*a*, 95*b*, 95*c*, 95*d*, 95*e*, 95*f* at or on the at least first window 11*a*, 11*b*, 11*c*, 11*d* during a predefined time period.

According to an aspect, responsive to a determination that the position of the object 8 is at a first position P1 within at least a first active area 95*a*, 95*b*, 95*c*, 95*d*, 95*e*, 95*f* at or on the at least first window 11*a*, 11*b*, 11*c*, 11*d* longer than a predefined time period, causing a fourth movement of the at least first window 11*a*, 11*b*, 11*c*, 11*d*. In an example the fourth movement is an upwards movement that completely closes the window 11*a*.

According to an aspect the processing circuitry 102 is configured to cause the window control system 100 to further determine a second position P2 of the object 8 within the at least first active area 95*a*, 95*b*, 95*c*, 95*d*, 95*e*, 95*f* wherein the second position P2 of the object 8 is determined within a certain time from the determination of the first position P1 of the object 8, and cause the at least a first window controller 10*a*, 10*b* to initiate a movement of the at least first window 11*a*, 11*b*, 11*c*, 11*d* that is a second movement of the at least first window 11*a*, 11*b*, 11*c*, 11*d*. This means that when the object 8 is moved from one position to another, e.g. swiped, from the first position P1 to the second position P2, the operation of the at least first window 11*a*, 11*b*, 11*c*, 11*d* can be one of a plurality of predefined operations causing the at least first window 11*a*, 11*b*, 11*c*, 11*d* to move accordingly.

Figure 2B:
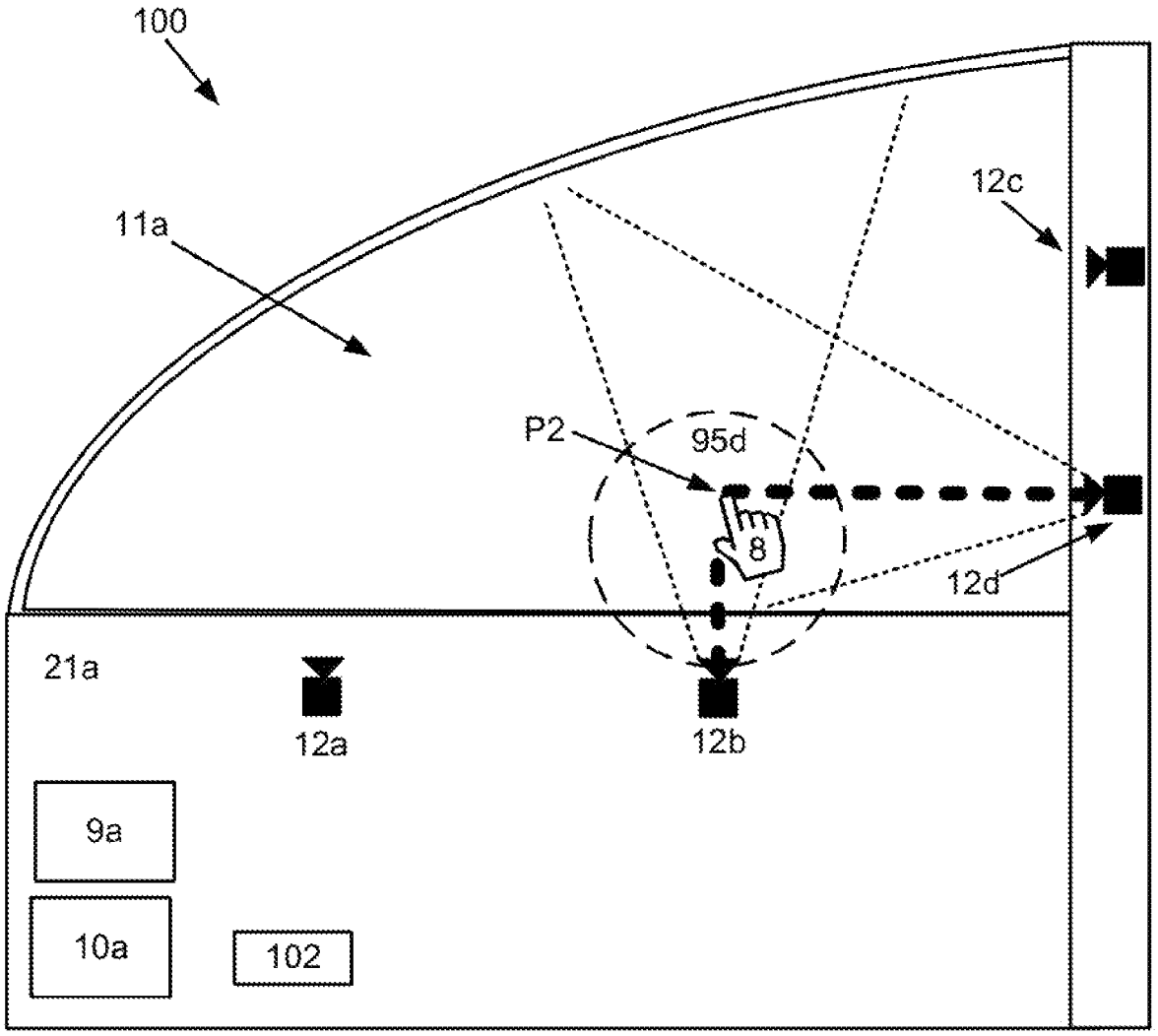
FIG. 2B illustrates the object at a second position within an active area at or on a window according to an aspect of the disclosure.

FIG. 2B illustrates the object 8 at a second position P2 within the active area 95*d* at or on the window 11*a* according to an aspect of the disclosure. In the illustration in FIG. 2B, the object 8 is in form of a finger of the vehicle occupant. In the example, the sensors 12*b* and 12*d* detect the finger 8 at the second position P2 within the active area 95*d*. In an example the finger 8 is touching the window 11*a* within the active area 95*d*. In an example the finger is not touching the window 11*a* but the finger is within the active area 95*d*. In the example as illustrated in FIG. 2B the second position P2 of the object 8 is determined within a certain time from the determination of the first position P1 of the object 8, as illustrated in FIG. 2A, and cause the at least a first window controller 10*a*, 10*b* to initiate a movement of the at least first window 11*a*, 11*b*, 11*c*, 11*d* that is a second movement of the at least first window 11*a*, 11*b*, 11*c*, 11*d*. In the example a swipe of the finger 8 that is moving downwards, from the first position P1 to the second position P2, is detected that causes the window 11*a* to initiate the second movement, e.g. a downwards movement of the window 11*a*.

According to an aspect the movement of the object 8 is detected when the object 8 is first detected in one active area 95*a*, 95*b*, 95*c*, 95*d*, 95*e*, 95*f* and then within a certain time the object is detected in another active area 95*a*, 95*b*, 95*c*, 95*d*, 95*e*, 95*f*. According to an aspect movement of the object 8 is detected within the same active area 95*a*, 95*b*, 95*c*, 95*d*, 95*e*, 95*f*.

According to an aspect an upward movement of a finger from a first position P1 to a second position P2 causes the at least first window 11*a* to close to a certain extent.

According to an aspect any of the distance, or the speed of the movement, between the first position P1 and the second position P2 determines to what extent the at least first window 11*a*, 11*b*, 11*c*, 11*d* moves. In an example the speed of the movement causes the at least first window 11*a*, 11*b*, 11*c*, 11*d* to move in a correlating speed. For example if the vehicle occupant swipes a finger fast in an upwards movement, the window is closing fast. In an example the distance of the movement causes the at least first window 11*a*, 11*b*, 11*c*, 11*d* to move in a correlating distance. For example if the vehicle occupant swipes a finger a certain distance at or on the window in an upwards movement, the window is moving upwards the same distance.

According to an aspect the intention by the vehicle occupant to move the window is determined by that the position of the object 8 is at a second position P2 within at least a first active area 95*a*, 95*b*, 95*c*, 95*d*, 95*e*, 95*f* at or on the at least first window 11*a*, 11*b*, 11*c*, 11*d* and the movement of the at least first window 11*a*, 11*b*, 11*c*, 11*d* is a third movement of the at least a first window 11*a*, 11*b*, 11*c*, 11*d*. In an example the third movement is to fully open the window 11*a*.

According to an aspect the at least first sensor 12*a*, 12*b*, 12*c*, 12*d* is configured to emit light and detect a reflection of the emitted light caused by the object 8. In other words if the object 8 comes in the way of the emitted light, the position of the object 8 can be determined by the reflected light.

According to an aspect the at least first sensor 12*a*, 12*b*, 12*c*, 12*d* is configured to detect light from at least a first light source 13*a*, 13*b*, 13*c*, 13*d*. FIG. 3 illustrates example light sources 13*a*, 13*b*, 13*c*, 13*d*. An advantage with this aspect is that it can be detected if the object 8 comes in between the at least first light source 13*a*, 13*b*, 13*c*, 13*d* and the at least first sensor 12*a*, 12*b*, 12*c*, 12*d* for determining the position of the object 8.

According to an aspect the at least first light source 13*a*, 13*b*, 13*c*, 13*d* is configured to emit light with a certain wavelength and/or emit a pulsing light that is pulsing at a certain frequency.

According to an aspect the at least first sensor 12*a*, 12*b*, 12*c*, 12*d* is configured to emit light with a certain wavelength and/or emit a pulsing light that is pulsing at a certain frequency.

An advantage with light with a certain wavelength and/or a pulsing light that is pulsing at a certain frequency is that the at least first sensor 12*a*, 12*b*, 12*c*, 12*d* can be configured to only detect light with the certain wavelength and/or the certain pulse frequency of the pulsing light for determining the position of the object 8.

According to an aspect the at least first light source 13*a*, 13*b*, 13*c*, 13*d* is configured to emit light and the at least first sensor 12*a*, 12*b*, 12*c*, 12*d* is configured to detect an interruption of the emitted light. According to an aspect the at least first sensor 12*a*, 12*b*, 12*c*, 12*d* is configured to emit light the at least first sensor 12*a*, 12*b*, 12*c*, 12*d* is further configured to detect a reflection of the emitted light.

In other words if the at least first light source 13*a*, 13*b*, 13*c*, 13*d* is used to emit light with a certain wavelength and/or a pulsing light, that is pulsing at a certain frequency, the at least first sensor 12*a*, 12*b*, 12*c*, 12*d* can be configured to detect an interruption of the specific light with the certain wavelength and/or the certain pulsing light, that is pulsing at the certain frequency.

Further, if the at least first sensor 12*a*, 12*b*, 12*c*, 12*d* is used to emit light with a certain wavelength and/or a pulsing light, that is pulsing at a certain frequency, the at least first sensor 12*a*, 12*b*, 12*c*, 12*d* can be configured to detect reflection of the specific light with the certain wavelength and/or the certain pulsing light, that is pulsing at the certain frequency.

In an example, light with a wavelength that is invisible by a human, such as infrared light, is used.

According to an aspect, the specific light with the certain wavelength is used for detecting a certain object with a certain colour. In an example the specific light with the certain wavelength is used for excluding detection of a certain object with a certain colour.

According to an aspect, the at least first sensor 12*a*, 12*b*, 12*c*, 12*d* is configured to determine at least one of a distance and a direction to the object 8 relative to the position of the at least first sensor 12*a*, 12*b*, 12*c*, 12*d*. In other words this means that the position of the object 8 can be determined. In an example the at least first sensor 12*a*, 12*b*, 12*c*, 12*d* is directed in a known direction and mounted at a known position and together with a known relation to at least a second sensor 12*a*, 12*b*, 12*c*, 12*d* directed in a known direction and mounted at a known position, the distance and the direction to the object 8 can be determined by the at least first sensor 12*a*, 12*b*, 12*c*, 12*d* and the at least second sensor 12*a*, 12*b*, 12*c*, 12*d*. In the illustration in FIG. 2A, the sensor 12*b* is directed in a known direction and mounted at a known position in relation to the sensor 12*c* that is also directed in a known direction and mounted at a known position in relation to the sensor 12*b*. In the example illustrated in FIG. 2A the two sensors 12*b* and 12*c* can together determine the position of the object 8 at the first position P1.

According to an aspect the at least first window 11*a*, 11*b*, 11*c*, 11*d* comprising at least a first symbol 90*a*, 90*b*, 90*c*, 90*d*, 90*e*, 90*f* According to an aspect the at least first symbol 90*a*, 90*b*, 90*c*, 90*d*, 90*e*, 90*f* is arranged at the at least first active area 95*a*, 95*b*, 95*c*, 95*d*, 95*e*, 95*f*. According to an aspect the at least first window 11*a*, 11*b*, 11*c*, 11*d* comprising at least a first symbol 90*a*, 90*b*, 90*c*, 90*d*, 90*e*, 90*f*, wherein the at least first symbol 90*a*, 90*b*, 90*c*, 90*d*, 90*e*, 90*f* is displayed only when the at least first symbol 90*a*, 90*b*, 90*c*, 90*d*, 90*e*, 90*f* is lit by light. This means that the at least first symbol 90*a*, 90*b*, 90*c*, 90*d*, 90*e*, 90*f* can be seen only when lit by light and e.g. be transparent if not lit by light in order to e.g. provide a see-through window or a clean surface of the door.

FIG. 3 illustrates example symbols 90*a*, 90*b*, 90*c*, 90*d*, 90*e*, 90*f* and active areas 95*a*, 95*b*, 95*c*, 95*d*, 95*e*, 95*f* at or on a window according to an aspect of the disclosure. In FIG. 3 the example symbol 90*a* illustrates a window that is just partly open. The example symbol 90*b* illustrates a window that is half open. The example symbols 90*c* and 90*e* illustrates a window that is closed. Further, the example symbols 90*d* and 90*f* illustrates a fully opened window.

In the example illustrations in FIG. 3, the symbol "partly open" 90*a* is within the active area 95*a*. The symbol "half open" 90*b* is within the active area 95*b*. The symbol "closed" 90*c* and 90*e* is within the active area 95*c* and the active area 95*e* respectively. The symbol "fully opened" 90*d* and 90*f* is within the active area 95*d* and the active area 95*f* respectively.

According to an aspect the door 21*a* comprising at least a first symbol 90*e*, 90*f* at a predetermined position at the door 21*a*. According to an aspect the at least first symbol 90*e*, 90*f* at the predetermined position of the door 21*a* is only visible when lit by light. In the example as illustrated in FIG. 3 the symbols at the door 21*a*, "closed" 90*e* and "fully opened" 90*f* are always at the same predetermined position at the door 21*a*. In other words the vehicle occupant will always know where to put the finger at the door in order to either fully open or to close the window. According to an aspect, in responsive to a determination that the position and/or movement of the of the object 8 is within the active area 95*e*, 95*f* of the predetermined position of the door 21*a*, cause the at least first window controller 10*a* to initiate a movement of the at least first window 11*a*. According to an aspect, in responsive to a determination that the position and/or movement of the of the object 8 is within the area of the predetermined position of the door 21*a*, cause the at least first window controller 10*a* to initiate any of at a closing movement or an open movement of the window 11*a*.

According to an aspect the at least first sensor 12*a*, 12*b*, 12*c*, 12*d* is configured to determine a position of the object 8, relative to the position of the at least first window 11*a*, 11*b*, 11*c*, 11*d*. An advantage with this aspect is that since the at least first window 11*a*, 11*b*, 11*c*, 11*d* is movable, the position of the object 8 relative to the at least first window 11*a*, 11*b*, 11*c*, 11*d* is changed dynamically when the at least first window 11*a*, 11*b*, 11*c*, 11*d* is moving, compared to the position of the object 8 relative to the at least first sensor 12*a*, 12*b*, 12*c*, 12*d* that is static.

According to an aspect the detected position and/or movement of the object 8 at the at least first active area 95*a*, 95*b*, 95*c*, 95*d* cause a certain operation of the window 11*a*, 11*b*, 11*c*, 11*d* dependent on the relative position of the window 11*a*, 11*b*, 11*c*, 11*d* in relation to the position of the door 21*a*, 21*b*, 21*c*, 21*d*.

Figure 4B:
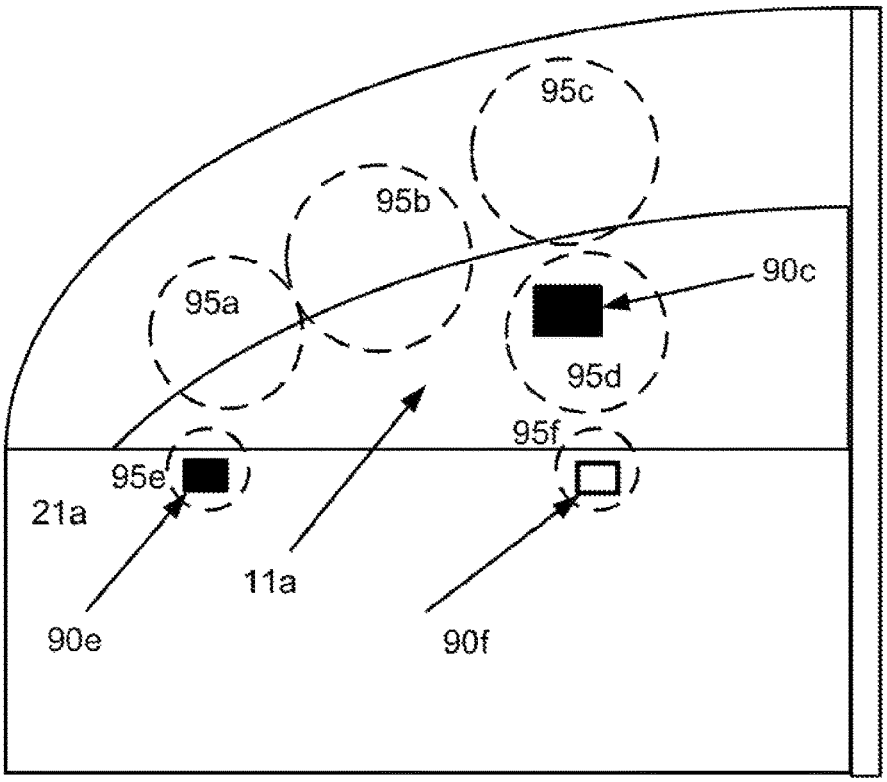
FIG. 4B illustrates example symbols and active areas at or on a window in an example half open position according to an aspect of the disclosure.

Reference is made to FIGS. 4A and 4B. In the illustrated example in FIG. 4A the window 11*a* is closed. In the FIG. 4A a detected position and/or movement of the object 8, e.g. the finger, at the active area 95*b* causes the window 11*a* to half open. When the window 11*a* is partly open, as illustrated in the FIG. 4B, a detected position and/or movement of the object 8, e.g. the finger, at the active area 95*d* causes the window 11*a* to close. Since the window 11*a* is moving, the symbols 90*a*, 90*b*, 90*c*, 90*d* of the window 11*a* are also moving accordingly. In the example, a detected position and/or movement of the object 8, e.g. the finger, at the active areas 95*e* and 95*f* at the door 21*a*, as illustrated in FIGS. 4A and 4B, will however cause the same operation of the window 11*a* independent on the relative position of the window 11*a* in relation to the position of the door 21*a*. In the example the vehicle occupant can either operate the window by e.g. moving a finger in any of the active areas on the window, or moving a finger in any of the active areas on the door 21*a*.

Figure 5:
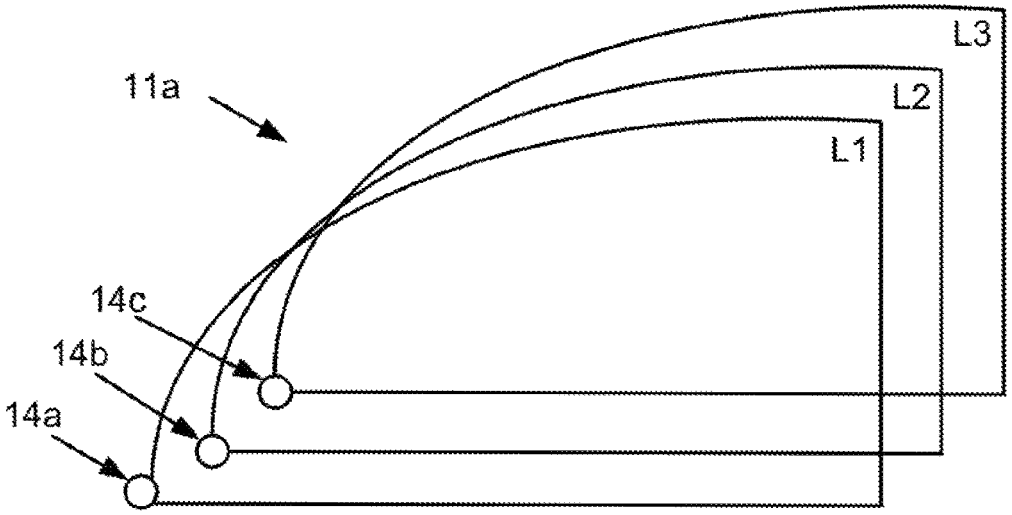
FIG. 5 illustrates a window that comprises at least a first layer according to an aspect of the disclosure.

According to an aspect, as illustrated in FIG. 5, the at least first window 11*a*, 11*b*, 11*c*, 11*d* comprising at least a first layer L1, L2, L3 and the at least first symbol 90*a*, 90*b*, 90*c*, 90*d* is comprised in the at least first layer L1, L2, L3. According to an aspect the layers L1, L2, L3 are glued or pressed together to form the window 11*a*, 11*b*, 11*c*, 11*d*. According to an aspect the at least first symbol 90*a*, 90*b*, 90*c*, 90*d* is lit by light by at least a first light source 14*a*, 14*b*, 14*c* arranged at the at least first layer L1, L2, L3. The at least first light source 14*a*, 14*b*, 14*c* is illustrated in FIG. 5. According to an aspect the at least first light source 14*a*, 14*b*, 14*c* is configured to only emit light in one of the at least first layers L1, L2, L3. In FIG. 5 the at least first light source 14*a* is mounted on the edge of the at least first layer L1 configured to transport light in the first layer L1.

Figure 6A:
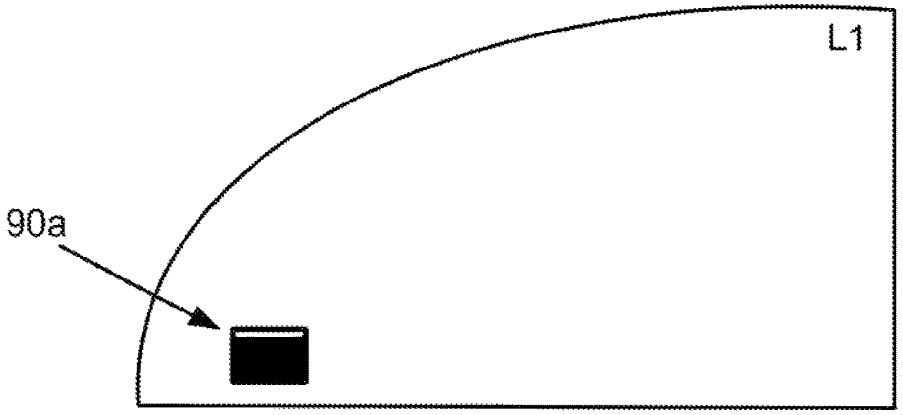
FIGS. 6A-6C illustrates window layers and at least a first symbol comprised in each layer.
Figure 6B:
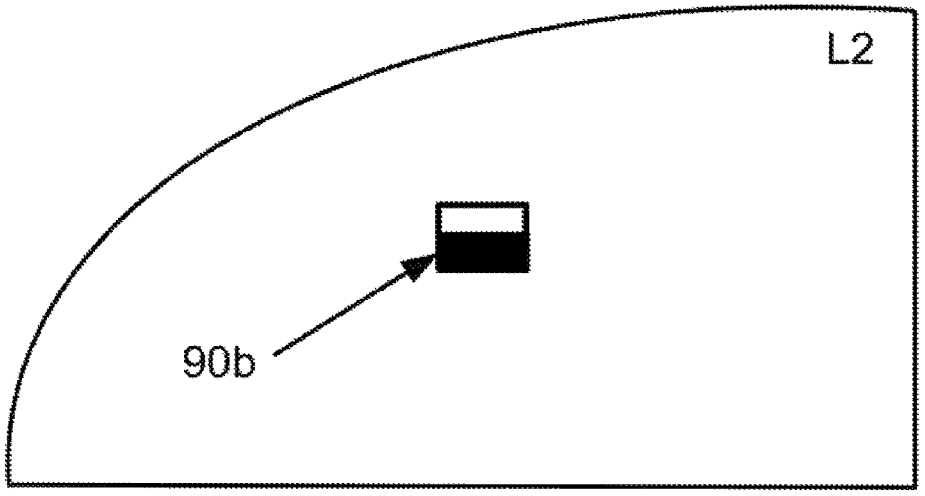
Figure 6C:
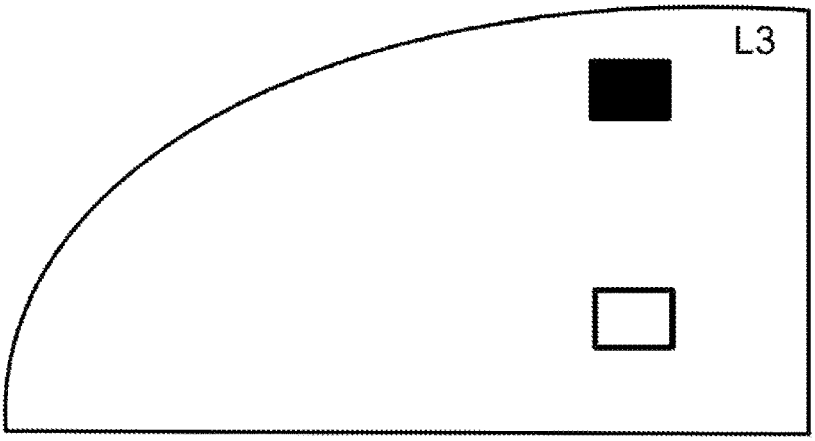

According to an aspect, the at least first window 11*a* comprising at least a first layer L1 and a second layer L2 and the first symbol 90*a* is comprised in the first layer L1 and a second symbol 90*b* is comprised in the second layer L2. In the FIGS. 6A and 6B example symbols 90*a*, 90*b* are illustrated in the first and second layer respectively. The FIG. 6C illustrates an example layer L3 with two symbols. This solution provides for e.g. the advantage that different symbols 90*a*, 90*b*, 90*c*, 90*d* can be comprised in different layers of the L1, L2, L3 of the at least first window 11*a*, 11*b*, 11*c*, 11*d*. In an example the different symbols 90*a* and 90*b*, as illustrated in FIGS. 6A and 6B, can be lit independently by the light source 14*a* and 14*b* respectively.

According to an aspect, the at least first window 11*a* comprising at least a first layer L1 and a second layer L2 and the first symbol 90*a* is comprised in the first layer L1 and a second symbol 90*b* is comprised in the second layer L2. In the FIGS. 6A and 6B the example symbols 90*a*, 90*b* illustrated in the first and second layer respectively have different appearances. According to an aspect the first symbol 90*a* comprised in the first layer L1 and the second symbol 90*b* comprised in the second layer L2 have the same appearance. In an example, using the same appearance of the symbols 90*a*, 90*b* will cause the effect of that the symbol is moving on the window 11*a*. For example, if the symbols 90*a*, 90*b* as illustrated in the FIGS. 6A and 6B looks the same, i.e. have the same appearance, e.g. by a same icon illustrating an "open" operation of the window 11*a*, the symbol 90*a* in FIG. 6A at the down left corner can be visible when the window 11*a* is closed, while if the window 11*a* is half open, the symbol 90*b* in FIG. 6B at the centre of the window 11*a* will instead be visible, showing the same icon illustrating an "open" operation of the window 11*a*.

Figure 7:
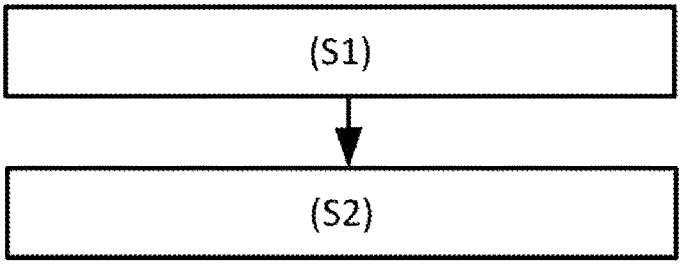
FIG. 7 illustrates a flow chart of the method steps according to some aspects of the disclosure.

The disclosure further proposes a method for managing movement of at least a first window 11*a*, 11*b*, 11*c*, 11*d*. The method is illustrated in FIG. 7. The method comprising the step of S1 detecting, by at least a first sensor 12*a*, 12*b*, 12*c*, 12*d*, a position and/or movement of an object 8 at or on the at least first window 11*a*, 11*b*, 11*c*, 11*d*. The method further comprising the step of S2 determining, if the position and/or movement of the object 8 detected by the at least first sensor 12*a*, 12*b*, 12*c*, 12*d* represents an intention by a vehicle occupant to move the at least first window 11*a*, 11*b*, 11*c*, 11*d* and responsive to a determination that the position and/or movement of the of the object 8 represents an intention by the vehicle occupant to move the at least first window 11*a*, 11*b*, 11*c*, 11*d*, cause the at least first window controller 10*a*, 10*b* to initiate a movement of the at least first window 11*a*, 11*b*, 11*c*, 11*d* accordingly. An advantage with the vehicle window control system 100 is that the vehicle occupant can operate the at least first window 11*a*, 11*b*, 11*c*, 11*d* intuitively by e.g. a finger at or on the window, without the need for a certain switch or button for operating the at least first window 11*a*, 11*b*, 11*c*, 11*d*.

According to an aspect the intention by the vehicle occupant to move the at least first window 11*a*, 11*b*, 11*c*, 11*d* is determined by that the position of the object 8 is at a first position P1 within at least a first active area 95*a*, 95*b*, 95*c*, 95*d*, 95*e*, 95*f* at or on the at least first window 11*a*, 11*b*, 11*c*, 11*d* and that the movement of the at least first window 11*a*, 11*b*, 11*c*, 11*d* is a first movement of the at least first window 11*a*, 11*b*, 11*c*, 11*d*. According to an aspect the at least first active area 95*a*, 95*b*, 95*c*, 95*d*, 95*e*, 95*f* is defined by an area where at least a first sensor 12*a*, 12*b*, 12*c*, 12*d* is configured to detect a position and/or movement of an object 8. This means that when the object 8 is at the first position P1 within the at least a first active area 95*a*, 95*b*, 95*c*, 95*d*, 95*e*, 95*f*, the operation of the at least first window 11*a*, 11*b*, 11*c*, 11*d* can be one of a plurality of predefined operations causing the at least first window 11*a*, 11*b*, 11*c*, 11*d* to move accordingly.

According to an aspect the method further comprising a determination of a second position P2 of the object 8 within the at least first active area 95*a*, 95*b*, 95*c*, 95*d*, 95*e*, 95*f*, and the second position P2 of the object 8 is determined within a certain time from the determination of the first position P1 of the object 8, causing the at least a first window controller 10*a*, 10*b* to initiate a movement of the at least first window 11*a*, 11*b*, 11*c*, 11*d* that is a second movement of the at least a first window 11*a*, 11*b*, 11*c*, 11*d*. This means that when the object 8 is moved from one position to another, e.g. swiped, from the first position P1 to the second position P2, the operation of the at least first window 11*a*, 11*b*, 11*c*, 11*d* can be one of a plurality of predefined operations causing the at least first window 11*a*, 11*b*, 11*c*, 11*d* to move accordingly.

Figure 8:
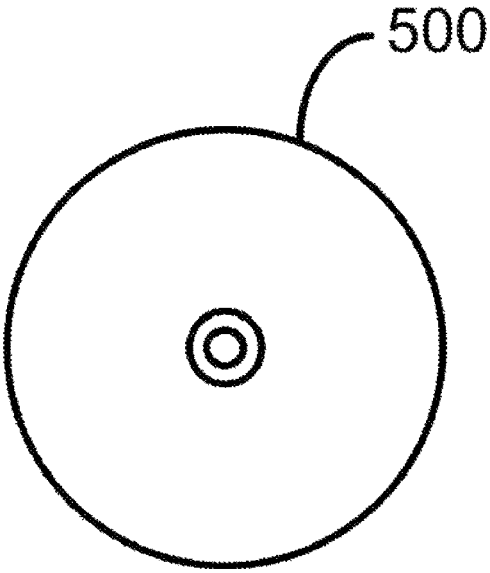
FIG. 8 illustrates a computer program product according to some aspects of the disclosure.

The disclosure further proposes, as illustrated in FIG. 8, a computer program product 500 comprising a non-transitory computer readable medium, having thereon a computer program comprising program instructions, the computer program being loadable into a processing circuitry 102 and configured to cause execution of the method when the computer program is run by the at least one processing circuitry 102.

According to an aspect the vehicle window control system 100 is configured to carry out any or more of the aspects of the described method. According to an aspect of the disclosure, the method is carried out by instructions in a software program that is downloaded and run in the vehicle window control system 100.

In the drawings and specification, there have been disclosed exemplary embodiments. However, many variations and modifications can be made to these embodiments. Accordingly, although specific terms are employed, they are used in a generic and descriptive sense only and not for purposes of limitation, the scope of the embodiments being defined by the following claims.

What is claimed is:

1. A vehicle window control system for managing movement of a first window, the vehicle window control system comprises:

the first window comprising a first layer and a first symbol comprised in the first layer wherein the first symbol is displayed only upon lighting of the first symbol by light;

a first light source arranged at the first layer of the first window;

a first window controller configured to move the first window;

a first sensor configured to detect a position and/or movement of an object; and a processing circuitry operatively connected to the first sensor and the first window controller and configured to cause the window control system to:

determine that the position and/or movement of the object detected by the first sensor represents an intention by a vehicle occupant to move the first window; and responsive to a determination that the position and/or movement of the object represents the intention by the vehicle occupant to move the first window, cause the first window controller to initiate a movement of the first window, wherein the first window further comprising second layer and a second symbol comprised in the second layer, and the first light source is configured to only emit light in the first layer.

2. The vehicle window control system according to claim 1, wherein the intention by the vehicle occupant to move the window is determined by that the position of the object is at a first position within a first active area at or on the first window and the movement of the first window is a first movement of the a first window.

3. The vehicle window control system according to claim 2, wherein the processing circuitry is configured to cause the window control system to further determine a second position of the object within the first active area wherein the second position of the object is determined within a certain time from the determination of the first position of the object, and cause the first window controller to initiate a second movement of the first window.

4. The vehicle window control system according to claim 1, wherein the first sensor is configured to emit light and detect a reflection of the emitted light caused by the object.

5. The vehicle window control system according to claim 1, wherein the first sensor is configured to detect light from the first light source.

6. The vehicle window control system according to claim 5, wherein the first light source is configured to emit light with a certain wavelength and/or emit a pulsing light that is pulsing at a certain frequency.

7. The vehicle window control system according to claim 1, wherein the first sensor is configured to determine at least one of a distance or a direction to the object relative to a position of the first sensor.

8. The vehicle window control system according to claim 1, wherein the first sensor is configured to determine the position of the object relative to the first window.

9. A method configured to manage movement of the first window of the vehicle window control system according to claim 1, the method comprising:

detecting, by the first sensor, a position and/or movement of the object at or on the first window;

determining that the position and/or movement of the object detected by the first sensor represents the intention by a vehicle occupant to move the first window; and responsive to a determination that the position and/or movement of the object represents the intention by the vehicle occupant to move the first window, causing the first window controller to initiate the movement of the first window.

10. The method according to claim 9, wherein the intention by the vehicle occupant to move the first window is determined by that the position of the object is at a first position within a first active area at or on the first window and that the movement of the first window is a first movement of the first window.

11. The method according to claim 10, wherein a second position of the object is determined within the first active area, and the second position of the object is determined within a certain time from the determination of the first position of the object, causing the first window controller to initiate a second movement of the first window.

12. A computer program product comprising a non-transitory computer readable medium, having stored thereon a computer program comprising program instructions, the computer program being loadable into the processing circuitry of the vehicle window control system and configured to cause execution of the method according to claim 9 when the computer program is run by the processing circuitry of the vehicle window control system.

* * * * *